US006419320B1

(12) United States Patent
Wang

(10) Patent No.: US 6,419,320 B1
(45) Date of Patent: Jul. 16, 2002

(54) BASE MANIPULATION DEVICE FOR OFFICE CHAIR

(75) Inventor: Bing-Nan Wang, Chiayi (TW)

(73) Assignee: Tung Yu Oa Co. Ltd., Chiayi (TW)

( * ) Notice: Subject to any disclaimer, the term of this patent is extended or adjusted under 35 U.S.C. 154(b) by 0 days.

(21) Appl. No.: 09/795,567

(22) Filed: Feb. 28, 2001

(51) Int. Cl.[7] ..... A47C 1/031

(52) U.S. Cl. ..... 297/344.19; 297/300.3; 297/300.7; 297/300.8; 297/302.6; 297/302.7

(58) Field of Search ..... 297/300.3, 300.4, 297/300.7, 300.8, 302.6, 302.7, 344.19, 463.1

(56) References Cited

U.S. PATENT DOCUMENTS 3,756,654 A * 9/1973 Bauer ..... 297/344.19
3,837,704 A * 9/1974 Bauer ..... 297/344.19
3,880,465 A * 4/1975 Scheben ..... 297/344.19
4,383,714 A * 5/1983 Ishida ..... 297/325
4,561,693 A * 12/1985 Brownlie et al. ..... 297/300.5
6,000,756 A * 12/1999 Hybarger et al. ..... 297/300.8
6,003,943 A * 12/1999 Schneider ..... 297/303.3
6,213,552 B1 * 4/2001 Miotto ..... 297/300.5

* cited by examiner

*Primary Examiner*—Peter M. Cuomo
*Assistant Examiner*—Joseph Edell
(74) *Attorney, Agent, or Firm*—Alan Kamrath; Rider, Bennett, Egan & Arundel, LLP

(57) ABSTRACT

A base manipulation device for an office chair includes a bottom plate having locking slots and pivoted with a chair base which has a rotation plate provided with a pivot plate and a drive plate. An operation bar is pivoted on the pivot plate and has a distal end pressed on the pneumatic bar. A positioning plate is secured on a rod which is moved with the drive plate. When the operation bar is driven to pivot vertically, the pneumatic bar is driven to adjust a height of a seat. When the operation bar is driven to move horizontally, the rotation plate is rotated to move the drive plate which moves the rod which moves the positioning plate to insert into or detach from one locking slot of the bottom plate, thereby achieving a purpose of adjusting an angle of inclination of the seat.

2 Claims, 7 Drawing Sheets

BASE MANIPULATION DEVICE FOR OFFICE CHAIR

BACKGROUND OF THE INVENTION

1. FIELD OF THE INVENTION

The present invention relates to a base manipulation device for an office chair.

2. DESCRIPTION OF THE RELATED PRIOR ART

The closest prior art of which the applicant is aware is disclosed in the Taiwanese Patent Publication No. 297246. In the said patent, the operation rod for operating the pneumatic bar 4 and the push rod 69 for operating the angle of inclination of the seat back are arranged in a separate manner, so that the operation thereof cannot be integrated, thereby causing inconvenience and difficulty in operation. In addition, the inclined angle of the seat back can be adjusted, but the inclined angle of the seat cushion cannot be adjusted, so that the design cannot suit the ergonomic and comfortable requirements.

SUMMARY OF THE INVENTION

In accordance with the present invention, there is provided a base manipulation device for an office chair, comprising: a seat cushion having a back face secured with a bottom plate which has a front end pivoted with a front end of a chair base which has a mediate portion mounted with a pneumatic bar, a seat back support rack having a distal end secured with a swing base which has a distal end pivoted with the mediate portion of the chair base, the bottom plate having a rear end having two sides each having a slide received in an elongated slot defined in each of two sides of the swing base, the bottom plate having a back face having a rear side secured with a locking portion defining a plurality of locking slots, wherein:

the mediate portion of the chair base has a top face provided with a rotatable rotation plate, the rotation plate is provided with an upright pivot plate and an upright drive plate, an operation bar is pivoted on the pivot plate and has a distal end that can be pressed on a control point of the pneumatic bar, a rod extends through the drive plate, a first elastic member is mounted on the rod and is urged between a first end of the rod and a first side of the drive plate, a second elastic member is mounted on the rod and is urged between a second end of the rod and a second side of the drive plate, a positioning plate is secured on the first end of the rod and is slidable in a space formed by a piece on the chair base;

when the operation bar is driven to pivot up and down, the pneumatic bar is driven to adjust a height of a seat;

when the operation bar is driven to move rightward and leftward, the rotation plate is rotated to move the drive plate which moves the rod which moves the positioning plate to insert into or detach from either one of the locking slots of the locking portion of the bottom plate, thereby achieving a purpose of adjusting an angle of inclination of the seat.

Further benefits and advantages of the present invention will become apparent after a careful reading of the detailed description with appropriate reference to the accompanying drawings.

DETAILED DESCRIPTION OF THE INVENTION

Figure 1:
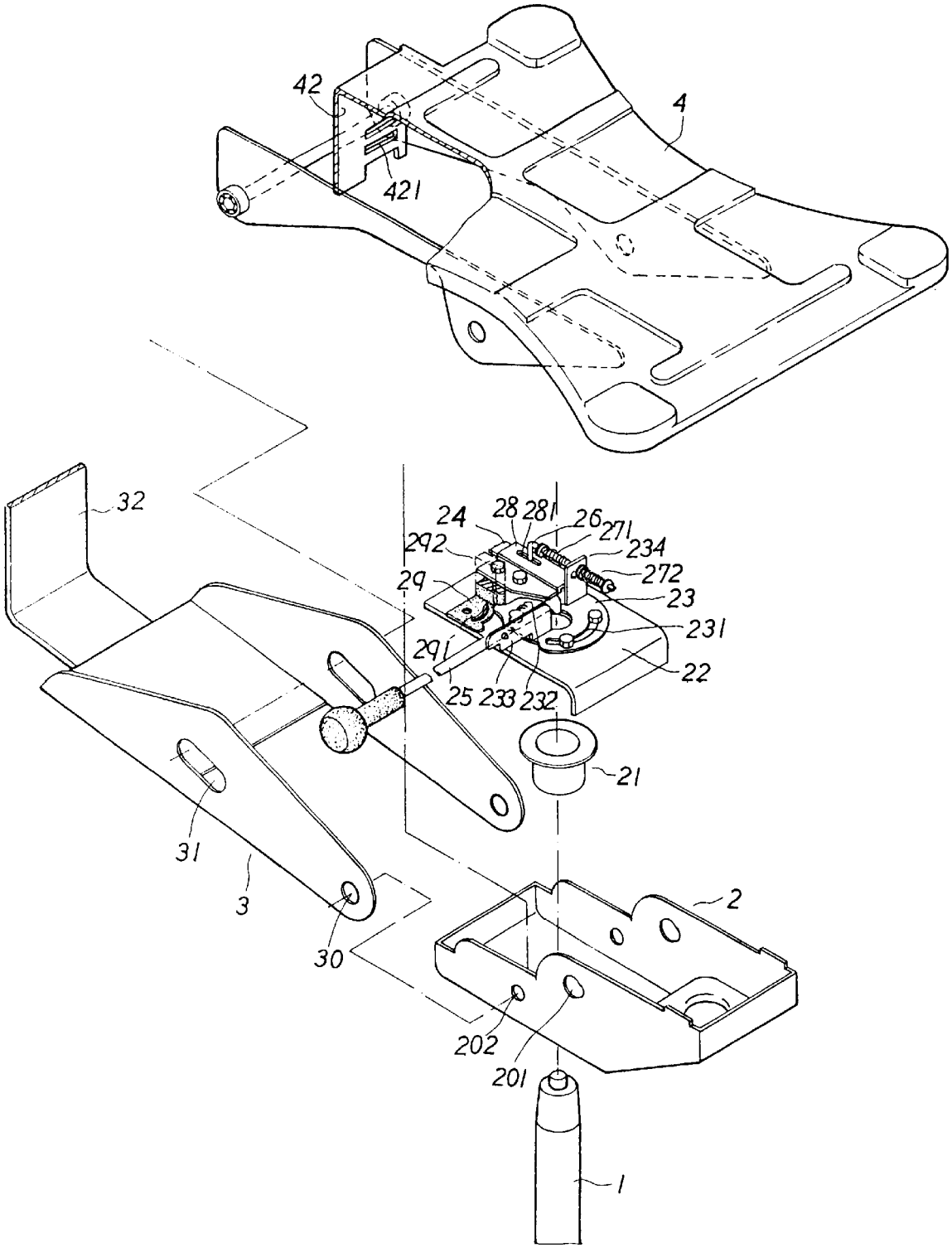
FIG. 1 is an exploded perspective view of a base manipulation device for an office chair in accordance with the present invention.
Figure 2:
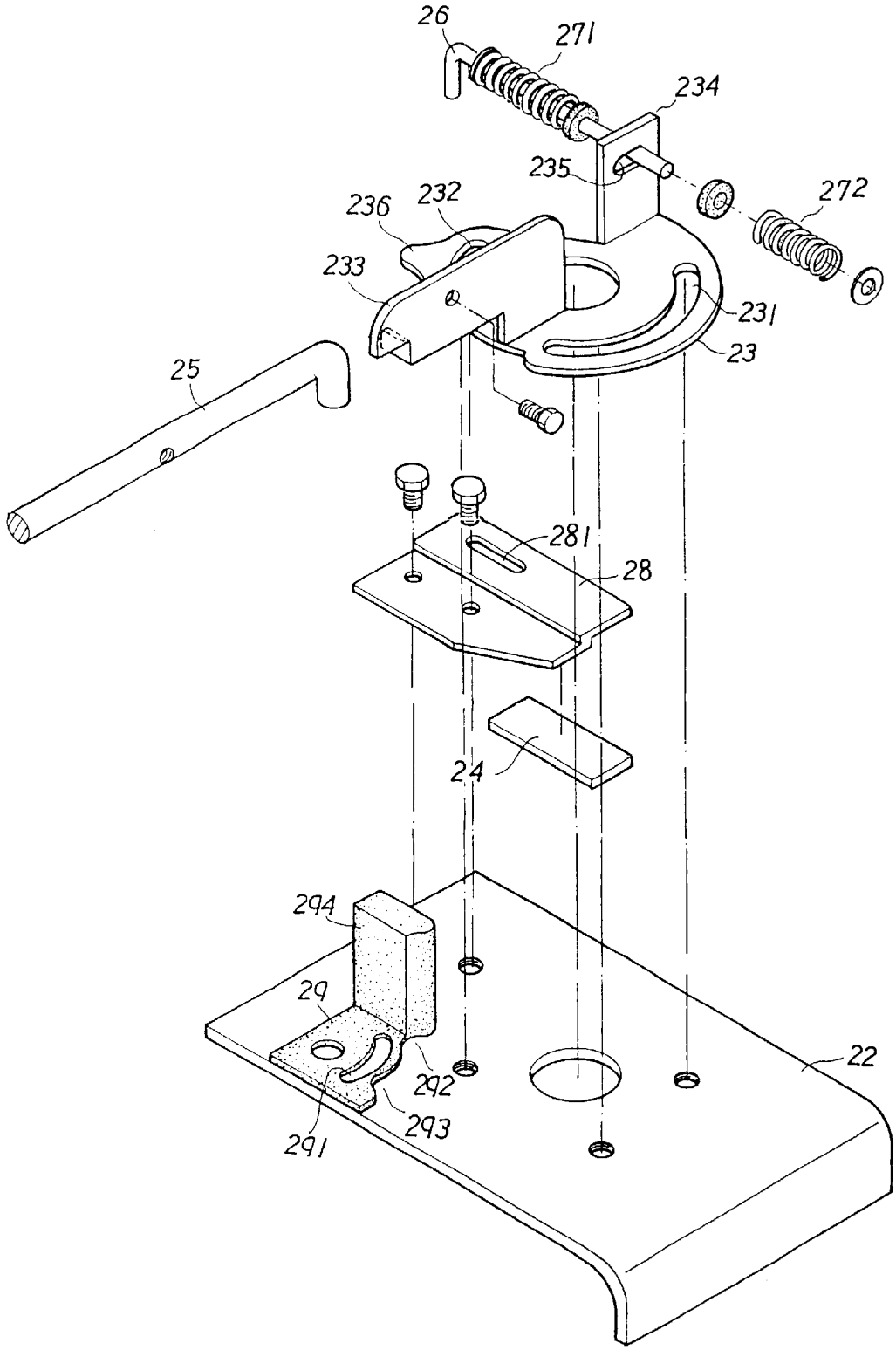
FIG. 2 is a locally exploded perspective view of the present invention.
Figure 3:
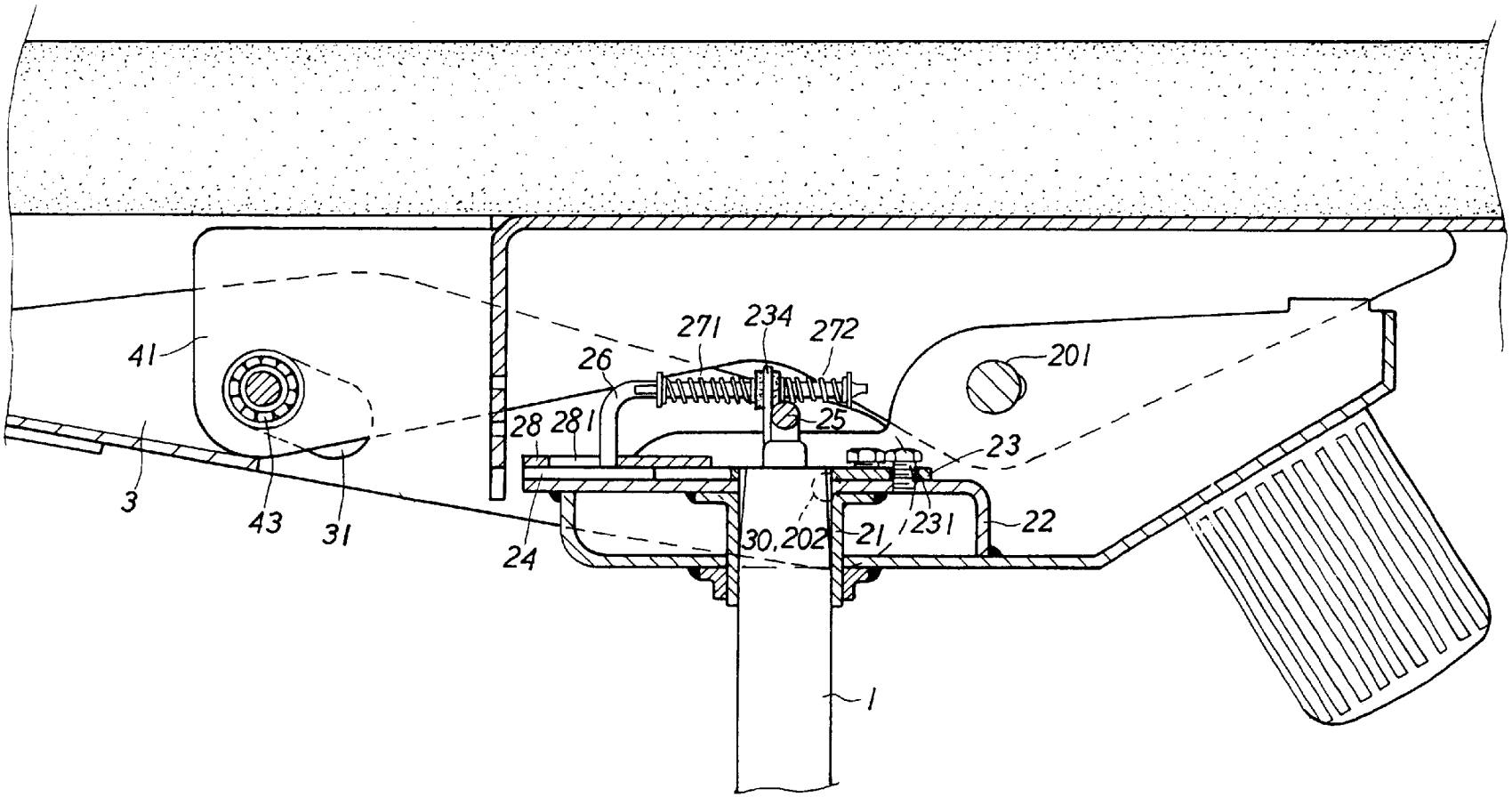
FIG. 3 is a side plan cross-sectional view of the present invention.

Referring to FIGS. 1–3, a base manipulation device for an office chair in accordance with the present invention comprises a seat cushion having a back face secured with a bottom plate 4, a seat back support rack 32 having a distal end secured with a swing base 3, and a chair base 2 secured on a top of a pneumatic bar 1.

The bottom plate 4 has a front end pivoted with the front end of the chair base 2 which has a mediate portion mounted with the pneumatic bar 1. An inverted U-shaped side base 41 is secured on the back face of the bottom plate 4, and has two side faces each having a front end defining a pivot hole and a rear end provided with a slide 43 which is received in an elongated slot 31 defined in each of two sides of the swing base 3. The bottom plate 4 has a back face having a rear side secured with a locking portion 42 defining a plurality of locking slots 421.

The swing base 3 has a distal end pivoted with the mediate portion of the chair base 2, and has a front end with two side faces each defining a pivot hole 30, and a mediate portion defining an elongated slot 31.

A ring 21 is secured on the back face of a fixed plate 22 which is integrally soldered on the base 2, whereby the top end of the pneumatic bar 1 may be inserted and fixed in the ring 21, and may slightly protrude outward from the fixed plate 22. The base 2 has two sides each having a front end defining a front pivot hole 201 and a rear end defining a rear pivot hole 202. A pivot axle extends through the pivot hole of the side base 41 of the bottom plate 4 and the front pivot hole 201 of the base 2, so that the bottom plate 4 is pivoted with the base 2 about the front pivot hole 201.

A pivot axle extends through the rear pivot hole 202 of the base 2 and the pivot hole 30 of the swing base 3, so that the swing base 3 is pivoted with the base about the rear pivot hole 202. The slide 43 of the side base 41 of the bottom plate 4 is received in the elongated slot 31 defined in each of two sides of the swing base 3.

A rotatable rotation plate 23 is mounted on the fixed plate 22 of the base 2. The rotation plate 23 defines two elongated arc-shaped slots 231, 232, and screws extend through the elongated arc-shaped slots 231, 232 and are then screwed on the fixed plate 22, whereby the rotation plate 23 may be rotated along the elongated arc-shaped slots 231, 232.

The rotation plate 23 is provided with an upright pivot plate 233 and an upright drive plate 234. An operation bar 25 is pivoted on the pivot plate 233 by a screw and has a distal end that can be pressed on the control point of the pneumatic bar 1. A rod 26 extends through an elongated slot 235 defined in the drive plate 234. A first elastic member 271 is mounted on the rod 26 and is urged between a first end of the rod 26 and a first side of the drive plate 234, and a second elastic member 272 is mounted on the rod 26 and is urged between a second end of the rod 26 and a second side of the drive plate 234. Each of the two elastic members 271, 272 is urged on the drive plate 234.

A stepwise piece 28 is secured on the fixed plate 22 of the chair base 2, and a space is formed between the piece 28 and the fixed plate 22. A positioning plate 24 is secured on the first end of the rod 26 to move therewith and is slidable in the space. The piece 28 defines an elongated slot 281, whereby the distal end of the rod 26 passes through the elongated slot 281, and is combined with the positioning plate 24.

A seat body 29 is secured on the fixed plate 22 of the base 2. The seat body 29 has a rim portion, and defines an arc-shaped slot 291 located adjacent to the rim portion so that the rim portion has an elastic effect. The rim portion of the seat body 29 has two ends each provided with a concave insertion portion 292, 293, and the rotation plate 23 has one side having a periphery provided with a lug 236 inserted into the insertion portion 292, 293 of the rim portion of the seat body 29. The seat body 29 has one side provided with an upright catch wall 294 for limiting the inclination of the bottom plate 4.

When the operation bar 25 is driven to pivot up and down about the pivot plate 233, the distal end of the operation bar 25 is pressed on the control point of the pneumatic bar 1 so that the pneumatic bar 1 can be lengthened or shortened so as to adjust the height of the seat.

Figure 4:
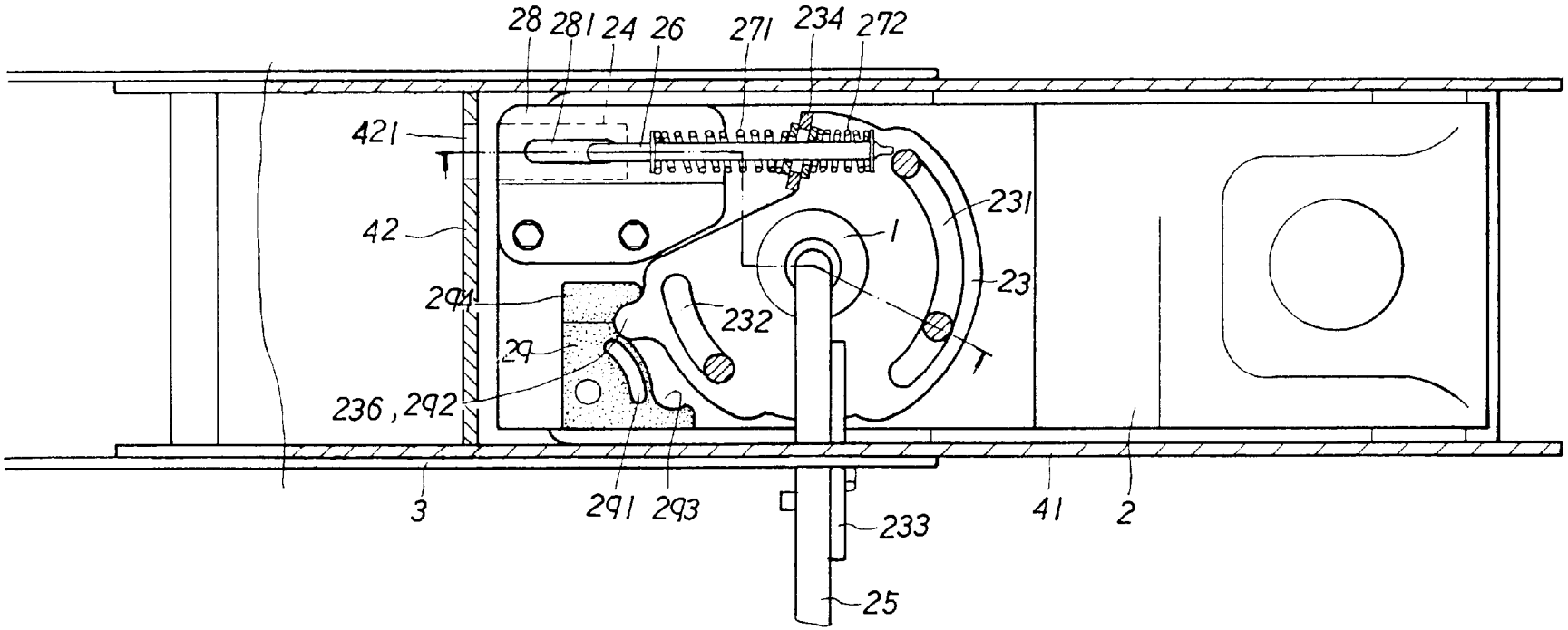
FIG. 4 is a top plan cross-sectional view of the present invention.
Figure 5:
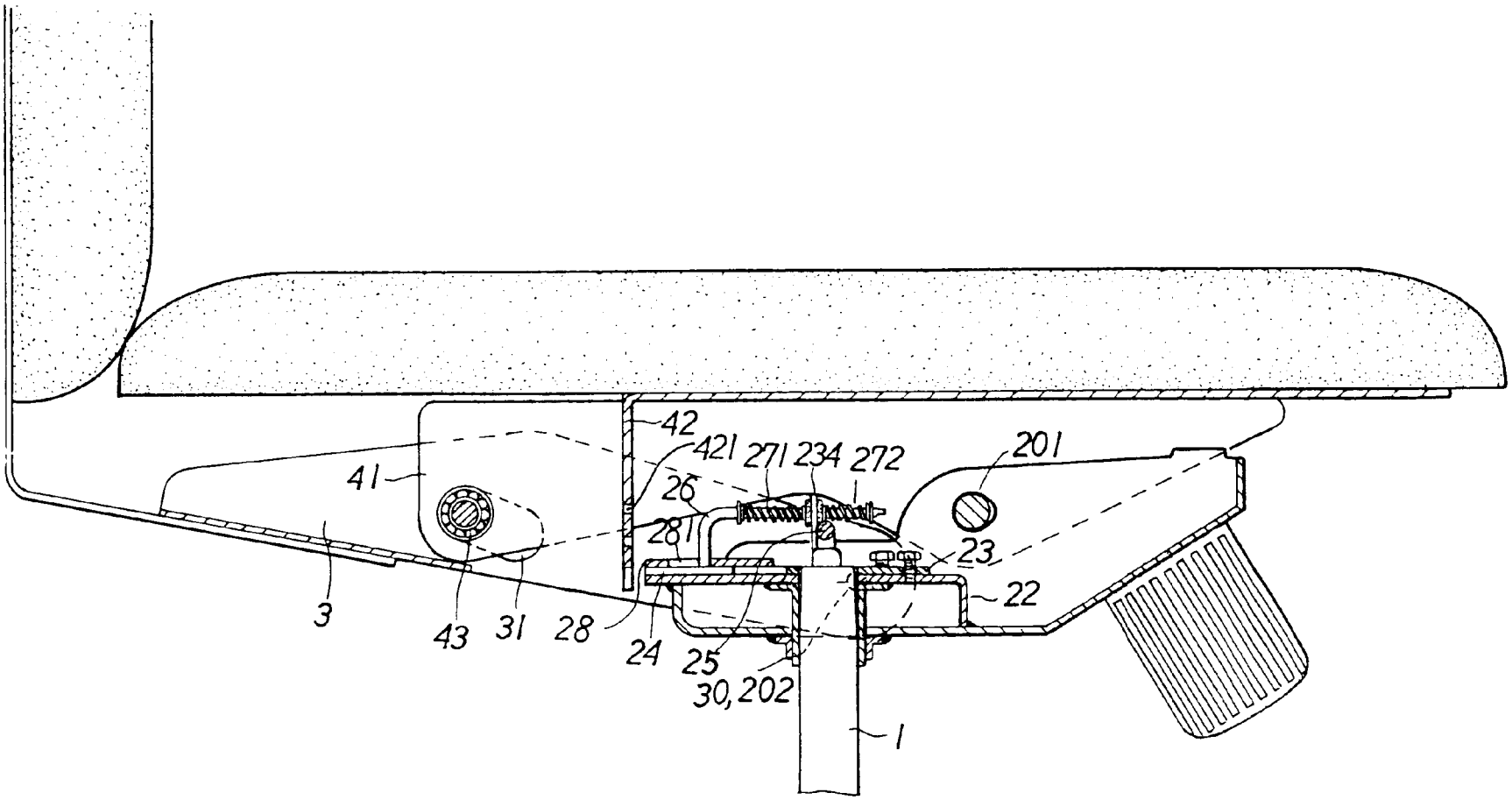
FIG. 5 is a side plan cross-sectional view of the present invention.
Figure 6:
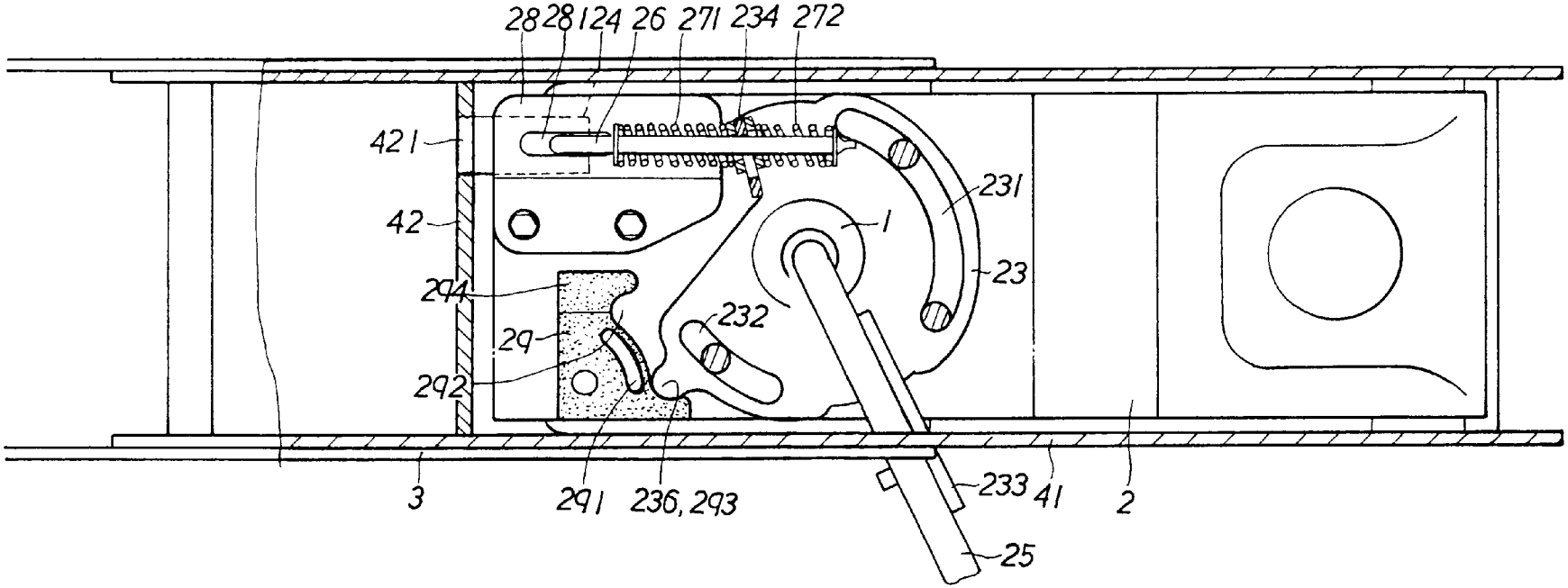
FIG. 6 is an operational view of FIG. 4 in use.
Figure 7:
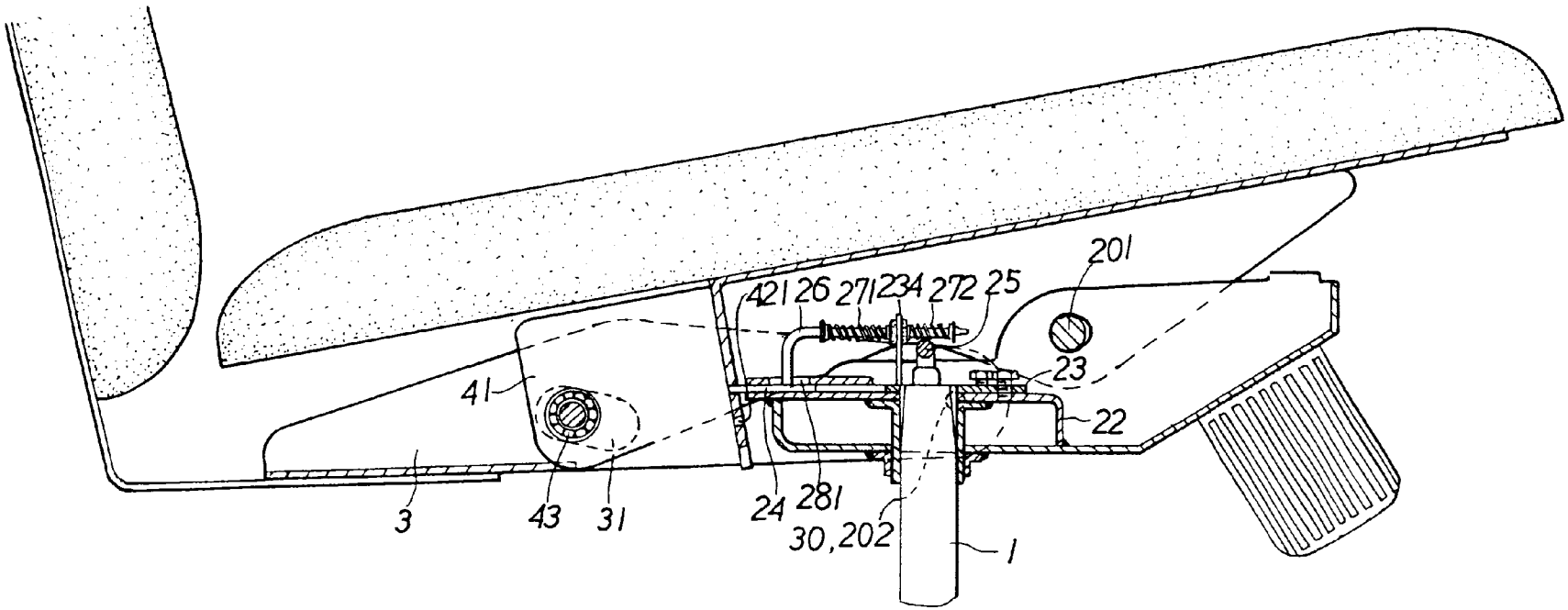
FIG. 7 is an operational view of FIG. 5 in use.

If the user wishes to have an inclined state, he may lean on the seat back so that the seat cushion and the seat back produce a linking inclination as shown in FIGS. 5 and 7. When the operation bar 25 is driven to move rightward and leftward as shown in FIGS. 4 and 6, the rotation plate 23 is rotated to move the drive plate 234 which forces the elastic member 271 to push the rod 26 which moves the positioning plate 24 to move outward to insert into or detach from either one of the locking slots 421 of the locking portion 42 of the bottom plate 4, thereby achieving a purpose of adjusting the angle of inclination of the seat.

If the user wishes to return the seat back to its original position or to adjust the other inclined angle of the seat, the operation bar 25 is driven to move to its original position, whereby the rotation plate 23 is rotated reversely so that the rod 26 produces a pre-force for returning under push of the elastic member 272. Then, under pressure of the user on the seat back, the positioning plate 24 may detach from the locking slot 421 of the locking portion 42 of the bottom plate 4, thereby adjusting the inclined angle of the seat or returning the seat back to its original position.

When the lug 236 of the rotation plate 23 is inserted into the insertion portion 292, 293 of the rim portion of the seat body 29, the rotation plate 23 may be positioned properly, thereby preventing the rotation plate 23 from rotating freely.

Although the invention has been explained in relation to its preferred embodiment as mentioned above, it is to be understood that many other possible modifications and variations can be made without departing from the scope of the present invention.

What is claimed is:

1. A base manipulation device for an office chair, comprising:

a seat cushion having a back face secured with a bottom plate (4) which has a front end pivoted with a front end of a chair base (2) which has a mediate portion mounted with a pneumatic bar (1), a seat back support rack (32) having a distal end secured with a swing base (3) which has a distal end pivoted with said mediate portion of said chair base (2), said bottom plate (4) having a rear end having two sides each having a slide (43) received in an elongated slot (31) defined in each of two sides of said swing base (3), said bottom plate (4) having a back face having a rear side secured with a locking portion (42) defining a plurality of locking slots (421), wherein:

said mediate portion of said chair base (2) has a top face provided with a rotatable rotation plate (23), said rotation plate (23) is provided with an upright pivot plate (233) and an upright drive plate (234), an operation bar (25) is pivoted on said pivot plate (233) and has a distal end that can be pressed on a control point of said pneumatic bar (1), a rod (26) extends through said drive plate (234), a first elastic member (271) is mounted on said rod (26) and is urged between a first end of said rod (26) and a first side of said drive plate (234), a second elastic member (272) is mounted on said rod (26) and is urged between a second end of said rod (26) and a second side of said drive plate (234), a positioning plate (24) is secured on said first end of said rod (26) and is slidable in a space formed by a piece (28) on said chair base (2);

when said operation bar (25) is driven to pivot up and down, said pneumatic bar (1) is driven to adjust a height of a seat;

when said operation bar (25) is driven to move rightward and leftward, said rotation plate (23) is rotated to move said drive plate (234) which moves said rod (26) which moves said positioning plate (24) to insert into or detach from either one of said locking slots (421) of said locking portion (42) of said bottom plate (4), thereby achieving a purpose of adjusting an angle of inclination of said seat.

2. The base manipulation device for an office chair in accordance with claim 1, further comprising a seat body (29) secured on said base (2), wherein, said seat body (29) has a rim portion, and defines an arc-shaped slot (291) located adjacent to said rim portion so that said rim portion has an elastic effect, said rim portion of said seat body (29) has two ends each provided with an concave insertion portion, and said rotation plate (23) has one side having a periphery provided with a lug (236) inserted into said insertion portion of said rim portion of said seat body (29).

* * * * *